US005089858A

United States Patent [19]

Ohno et al.

[11] Patent Number: 5,089,858

[45] Date of Patent: Feb. 18, 1992

[54] IMAGE FORMING APPARATUS OPERABLE WITH A TWO-SIDE UNIT

[75] Inventors: Yukihiro Ohno, Tokyo; Fumiaki Tsuchiya, Nakatsugawa, both of Japan

[73] Assignee: Ricoh Company, Ltd., Tokyo, Japan

[21] Appl. No.: 527,285

[22] Filed: May 23, 1990

[30] Foreign Application Priority Data

May 25, 1989 [JP] Japan ..... 1-130100

[51] Int. Cl.[5] ..... G03G 21/00

[52] U.S. Cl. ..... 355/319; 271/163; 271/164; 271/186; 355/309

[58] Field of Search ..... 355/309, 318, 319, 321; 271/162, 163, 164, 186

[56] References Cited

U.S. PATENT DOCUMENTS

| | | | |
|---|---|---|---|
| 4,660,963 | 4/1987 | Stemmle | 355/319 X |
| 4,835,567 | 5/1989 | Ogata | 355/319 X |
| 4,855,787 | 8/1989 | Hashimoto et al. | 355/319 X |
| 4,861,017 | 8/1989 | Yamamoto et al. | 271/162 X |
| 4,864,368 | 9/1989 | Muramatsu | 355/319 X |

FOREIGN PATENT DOCUMENTS

| | | | |
|---|---|---|---|
| 0171743 | 7/1988 | Japan | 271/164 |

*Primary Examiner*—A. T. Grimley
*Assistant Examiner*—J. E. Barlow, Jr.
*Attorney, Agent, or Firm*—Oblon, Spivak, McClelland, Maier & Neustadt

[57] ABSTRACT

An image forming apparatus selectively loaded with a two-side unit and a paper cassette storing a stack paper sheets and selectively operable in a two-sided copy mode and a combined copy mode. The body of the apparatus incorporates at least an image forming section, an image fixing section, a paper transporting section, and a paper discharging section therein. An accommodating section is provided in a lower portion of the apparatus body for selectively accommodating either one of the two-side unit and paper cassette. The accommodating section has a bore open at a particular side where the apparatus is to be operated, and a guide potion for guiding the two-side unit and paper cassette. The two-side unit and paper cassette have the same external configuration.

4 Claims, 11 Drawing Sheets

Fig.10A
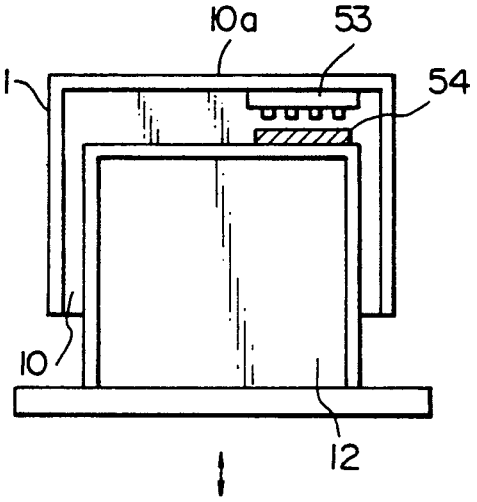
Fig.10B
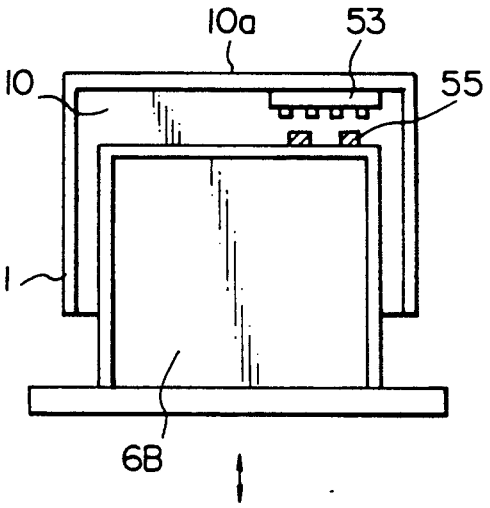
Fig.11A
Fig.11B
Fig.11C
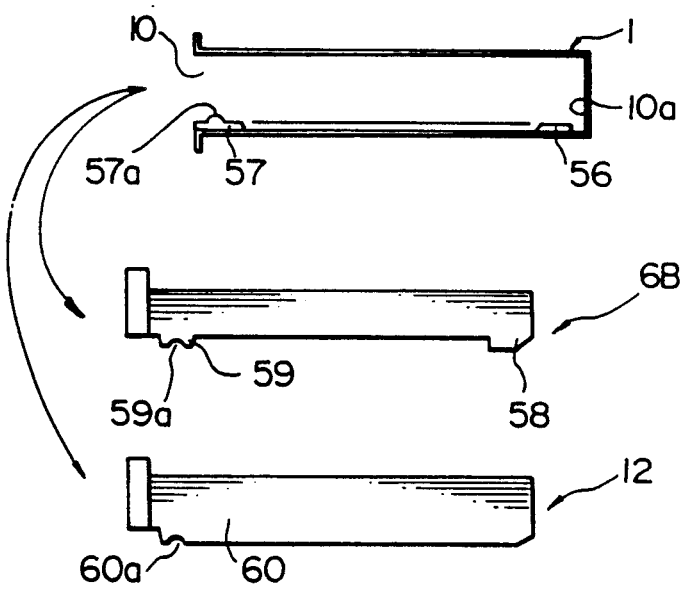

IMAGE FORMING APPARATUS OPERABLE WITH A TWO-SIDE UNIT

BACKGROUND OF THE INVENTION

The present invention relates to an image forming apparatus operable with a two-side unit for selectively forming a plurality of images on one side of a paper sheet and forming images on opposite sides of a paper sheet.

Generally, an electrophotographic copier or similar image forming apparatus using an electrophotographic procedure is required to have not only an ordinary function of copying an image on one side of a paper sheet but also a a function of forming images on both sides of a paper sheet (hereinafter referred to as a two-side copying function) and a function of forming a plurality of images together on one side of a paper sheet (hereinafter referred to as a combined copying function). An image forming apparatus using a two-side unit which is suitable for implementing the two-side and combined copying functions has been proposed (e.g. Japanese Patent Laid-Open Publication No. 208470/1988). The two-side unit has a paper transport path and a switchback section thereinside and is operatively connected to the rear end of an apparatus from which a paper sheet will be driven out. A drawback with this kind of scheme is that an extra space for accommodating the two-side unit has to be provided at the rear of the apparatus body. Further, the two-side unit or a paper cassette is inserted into and drawn out from the apparatus body at the side where paper sheets are to be driven out. This degrades the operability in the event of replacement of the two-side unit or the paper cassette and results in the need for an additional space for accommodating the operator as well. Other drawbacks with such a prior art approach are that the two-side unit and paper cassette each needs a paper tray, and that the two-side unit and paper cassette are different in external configuration from each other and, therefore, troublesome to handle and transport.

SUMMARY OF THE INVENTION

It is therefore an object of the present invention to provide an image forming apparatus free from the drawbacks particular to the prior art as discussed above.

It is another object of the present invention to provide an image forming apparatus which minimizes the space to be assigned to the body of the apparatus.

It is another object of the present invention to provide an image forming apparatus which is easy to operate and allows the user to see which of a two-side unit and a paper cassette is in use.

It is another object of the present invention to provide a generally improved image forming apparatus.

In accordance with the present invention, an image forming apparatus selectively loaded with a two-side unit and a paper cassette storing a stack of paper sheets is provided. The image forming apparatus is selectively operable in a two-sided copy mode and a combined copy mode for forming images on the paper sheets. The image forming apparatus comprises an apparatus body incorporating therein at least an image forming section, an image fixing section, a paper transporting section, and a paper discharging section, an accommodating section provided in a predetermined portion of the apparatus body for selectively accommodating either one of the two-side unit and the paper cassette, and a path selecting section for selecting either one of a path for guiding the paper sheet coming out of the image fixing section to the paper discharging section, and a path for guiding the paper sheet to the two-side unit which is loaded in the accommodating section.

BRIEF DESCRIPTION OF THE DRAWINGS

The above and other objects, features and advantages of the present invention will become more apparent from the following detailed description taken with the accompanying drawings in which:

FIGS. 10A and 10B are sections showing an arrangement for sensing the paper cassette and the two-side unit selectively mounted on the copier body; and FIGS. 11A to 11C are sections representative of an arrangement for positioning the paper cassette and two-side unit selectively mounted on the copier body.

DESCRIPTION OF THE PREFERRED EMBODIMENT

Figure 1:
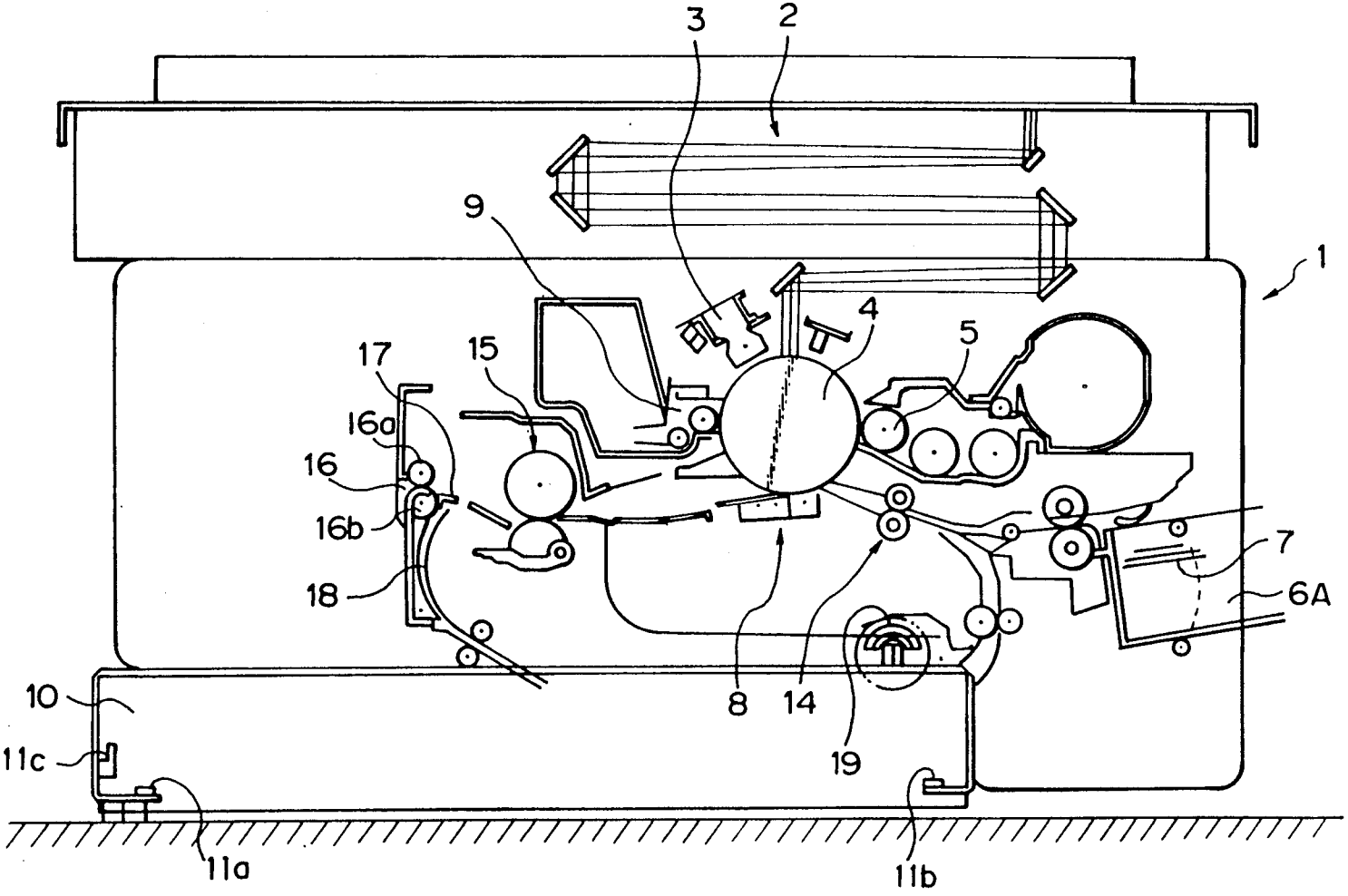
FIG. 1 is a section showing an image forming apparatus embodying the present invention and implemented as a copier.
Figure 2:
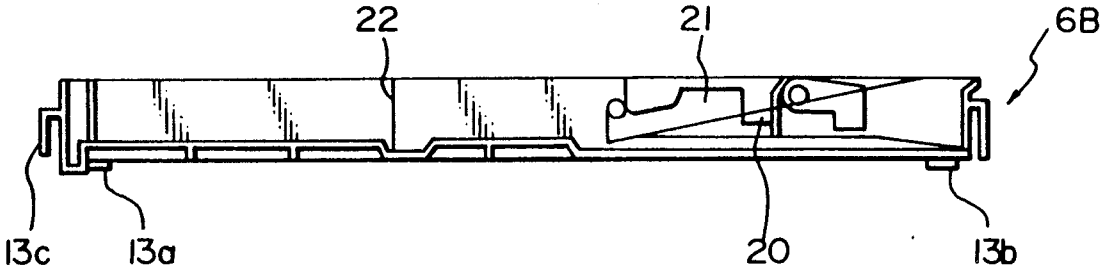
FIG. 2 is a section of a paper cassette which may be loaded in a bore formed in the body of the copier shown in FIG. 1.
Figure 3:
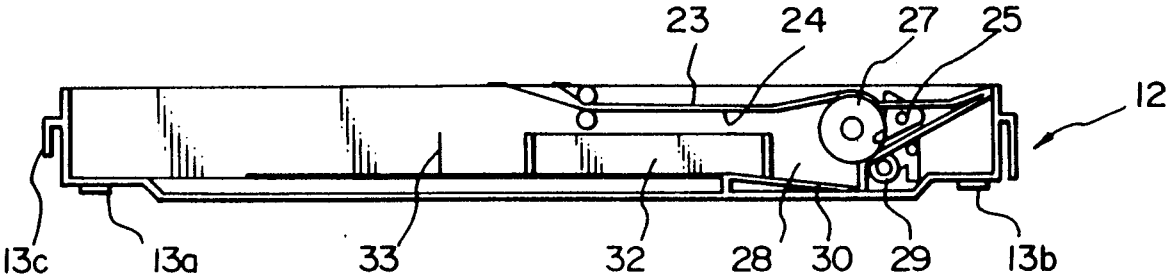
FIG. 3 is a section of a two-side unit which may also be loaded in the bore of the copier body.

Referring to FIGS. 1, 2 and 3 of the drawings, an image forming apparatus embodying the present invention is shown and implemented as a copier by way of example. As shown in FIG. 1, the copier has a body 1 and optics 2 disposed in an upper portion of the body 1. The optics 2 focuses image light representative of a document, not shown, onto a photoconductive drum 4 which has been uniformly charged by a main charger 3, whereby a latent image is electrostatically formed on the drum 4. A developing unit 5 develops the latent image to produce a toner image. A transfer and separation charger 8 is located at an image transfer station for transferring the toner image from the drum 4 to a paper sheet which is fed from either one of a paper cassette 6A loaded with paper sheets 7 and a paper cassette 6B, FIG. 2. The paper sheet carrying the toner image thereon is separated from the drum 4. After such image transfer, the drum 4 is cleaned by a cleaning unit 9 to remove toner particles remaining thereon and is thereby prepared for the next image transfer.

The copier body 1 has a bore 10 in a lower portion thereof and which is open at the side where the copier is to be operated. Horizontally extending positioning guides **11*a* and 11*b* are provided at opposite ends of the bore 10, while a positioning guide 11*c* is provided on one of opposite inner side walls of the copier body which define the bore 10. The paper cassette 6B shown in FIG. 2 and a two-side unit 12 shown in FIG. 3 may be selectively inserted into the bore 10 while being guided by the guides 11***a* and 11*b* in the up-and-down direction and by the guide 11*c* in the right-and-left direction. The paper cassette 6B and two-side unit 12 are configured to have the same external configuration. The paper cassette 6B and two-side unit 12 have respectively positioning pieces 13*a* and 13*b* which correspond in position to the positioning guides 11*a* and 11*b* of the bore 10, and positioning pieces 13*c* corresponding in position to the positioning guide 11*c* of the bore 10. The guides 11*a* and 11*b* and the pieces 13*a* and 13*b* mate with each other in a projection and recess configuration. The guide 11*c* and each of the pieces 13*c* are implemented as generally L-shaped rails that mate with each other.

As shown in FIG. 1, the paper sheet fed from any one of the paper cassettes 6A and 6B and two-side unit 12 is transported to the image transfer station via a register roller pair 14. After a toner image has been transferred from the drum 4 to the paper sheet at the image transfer station, the paper sheet is separated from the drum 4 and then fixed by a fixing unit 15. A selector in the form of a pawl 17 is interposed between the fixing unit 15 and a discharge roller pair 16, i.e., an upper and a lower discharge roller 16*a* and 16*b*, as will be described in detail later. The selector 17 selects either one of two different paper transport paths, i.e., a path extending to a copy tray, not shown, by way of the discharge roller pair 16 and a path extending to the two-side unit 12 by way of a curved guide section 18. A stack of paper sheets is stored in the paper cassette 6B while being positioned by the right end wall of the cassette 6B as viewed in FIG. 2. A semilunar roller 19 is mounted on the copier body 1 in a position corresponding to the leading edge of the paper sheets loaded on the paper cassette 6B. The paper cassette 6B has thereinside a pressing bottom plate 20, a positioning side plate 21, a positioning rear plate 22, etc., as usual.

Figure 4:
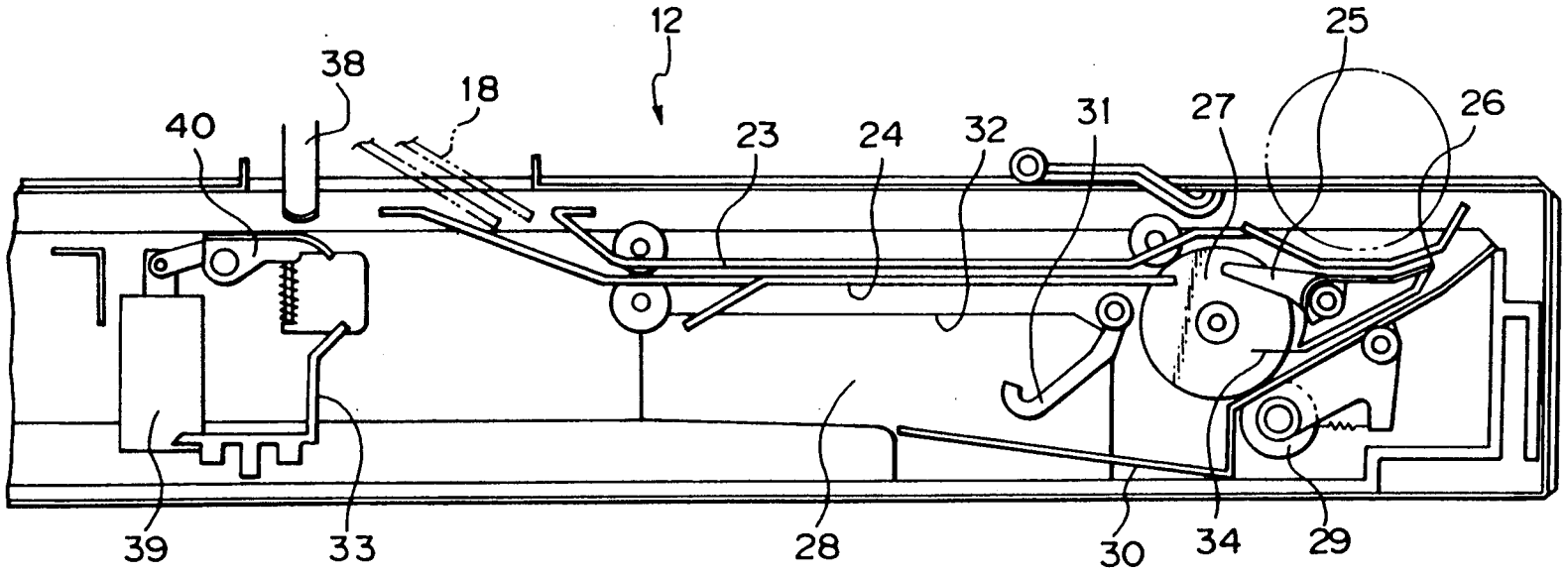
FIG. 4 is a fragmentary enlarged section of the two-side unit shown in FIG. 3.

As shown in an enlarged scale in FIG. 4, the two-side unit 12 has a guide path defined in an upper portion thereof by an upper and a lower guide plate 23 and 24. When the two-side unit 12 is mounted on the copier body 1, the guide path will be connected to the curved guide section 18 of the copier body 1. A selector in the form of a pawl 25 is located at one end of the guide path. The selector 25 connects the above-mentioned guide path to a path 26 for guiding a paper sheet from the two-side unit 12 directly to the copier body 1, or connects the guide path to a temporary stacking space 28 defined below the guide path for guiding a paper sheet to the space 28 along a reversible feed roller 27. The reversible feed roller 27 is rotated clockwise when a paper sheet is transported toward the stacking space 28 via the upper and lower guide plates 23 and 24 and selector 25, or counterclockwise when a paper sheet is fed out from the stacking space 28 toward the copier body 1. A separating roller 29 is held in contact with the feed roller 27 and provided with a one-way clutch. When the feed roller 27 rotates clockwise, the roller 29 follows the rotation of the roller 27. When the feed roller rotates counterclockwise, the roller 29 remains in a halt to separate one paper sheet from the others. In the stacking space 28, a bottom plate 30 is disposed to position the leading edge of paper sheets having been accommodated in the space 28 between the coactive rollers 27 and 29. A sensing member or feeler 31 is also disposed in the stacking space 28 to see if any paper sheet exists in the space 28. Also shown in FIG. 4 are a side jogger 32, a rear jogger 33, and a refeed guide Mylar 34.

Figure 5:
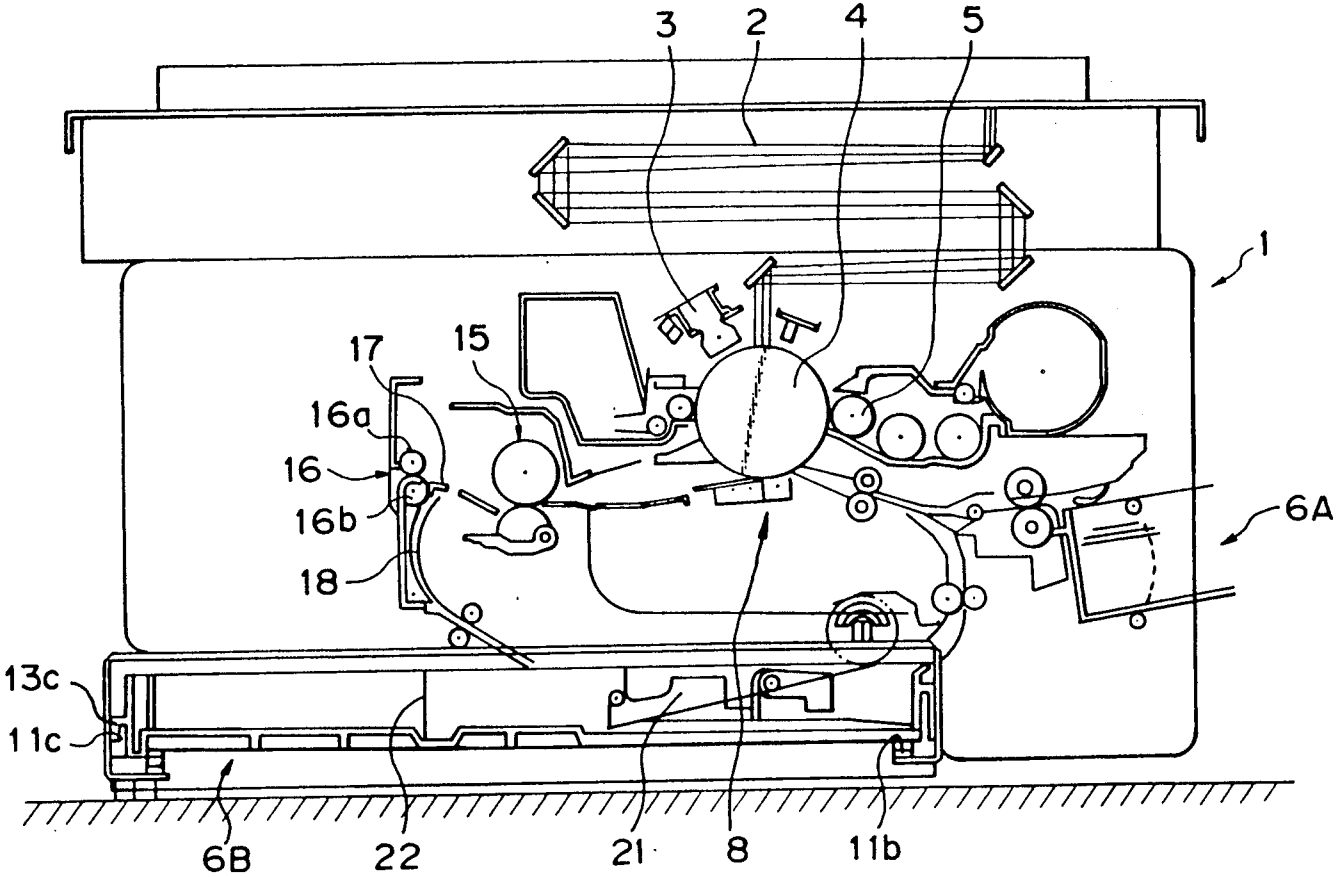
FIG. 5 is a section showing the copier body of FIG. 1 which is loaded with the paper cassette.
Figure 6:
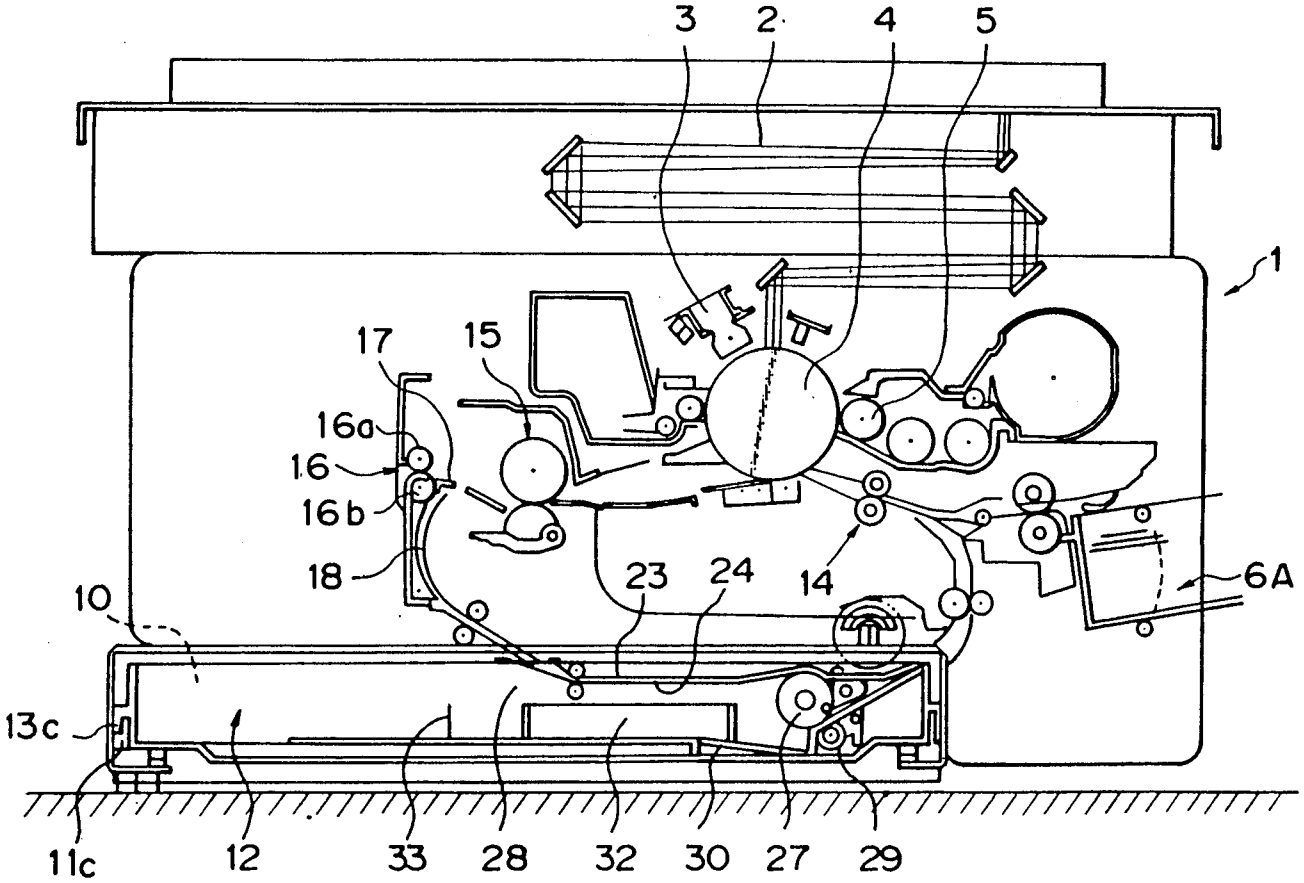
FIG. 6 is a section showing the copier body of FIG. 1 which is loaded with the two-side unit.

In an ordinary copy mode operation, the paper cassette 6B is set in the bore 10 of the copier body 1, as shown in FIG. 5. As a paper sheet fed from the paper cassette 6A or 6B reaches the image transfer station, a toner image is transferred from the drum 4 to the paper sheet and then fixed on the paper sheet, as stated previously. The paper sheet carrying the fixed image thereon is driven out of the copier body by the discharge roller pair 16. On the other hand, in a combined copy mode or two-sided copy mode operation, the two-side unit 12 is inserted in the bore 10, as shown in FIG. 6. In the condition shown in FIG. 6, the selector 17 intervening between the fixing unit 15 and the discharge roller pair 16 is switched over from the discharge roller pair 16 side to the curved guide section 18 side, as will be described specifically later.

In the combined copy mode, the selector 25 of the two-side unit 12, FIG. 4, is rotated to a horizontal position. Then, a paper sheet undergone a copying process and fixed by the fixing unit 15 is routed through the curved guide section 18 to the guide path defined in the two-side unit 12 by the upper and lower guide plates 23 and 24, and further to the register roller pair 14 of the copier body 1 via the selector 25. This allows another image to be formed on the same side of the paper sheet. In a two-sided copy mode, the selector 25 is rotated to an upright position so that a paper sheet carrying an image on one side thereof and routed through the curved guide section 18 and upper and lower guide plates 23 and 24 is steered by the selector 25 toward the rollers 27 and 29. Then, the roller 27 rotating clockwise and the roller 29 following the rotation of the roller 27 drive the incoming paper sheet into the stacking space 28.

The side jogger 32 and rear jogger 33 disposed in the stacking space 28 accurately position the paper sheet having been driven into the space 28 face down. To form an image on the other side of such paper sheets sequentially stacked in the space 28, the bottom plate 30 located at the leading edge of the paper stack is raised until it nips the leading edge of the paper stack in cooperation with the roller 27. Then, the roller 27 rotating counterclockwise and the roller 29 remaining in a halt cooperate to refeed one of the paper sheets out of the stacking space 28 while separating it from the others. The paper sheet is transported to an image forming station which is defined in the copier body 1.

In the illustrative embodiment, the copier is constructed such that one of the paper cassette 6B and two-side unit 12 having the same shape are selectively mounted on the copier body 1. A user, therefore, may purchase this type of copier having the bore 10 in its body 1 and then purchase the two-side unit 12 optionally. For users who do not need the two-side unit 12, the selector 17 intervening between the discharge roller pair 16 and the fixing unit 16 and the curved guide section 18 would be undesirable from the cost standpoint. In the illustrative embodiment, therefore, although the selector 17 is provided in the copier body 1 beforehand, it is caused to function as a discharge guide plate between the fixing unit 15 and the discharge roller pair 16 during the course of an ordinary copying operation. When the two-side unit 12 is used with the copier, the selector 17 is operated to switch over the transport path to the curved guide section 18 side in interlocked relation to an actuating member provided on the two-side unit 12. A predetermind part of the curved guide section 18 is removable from the copier body and may be purchased together with the optional two side unit 12.

Figure 7:
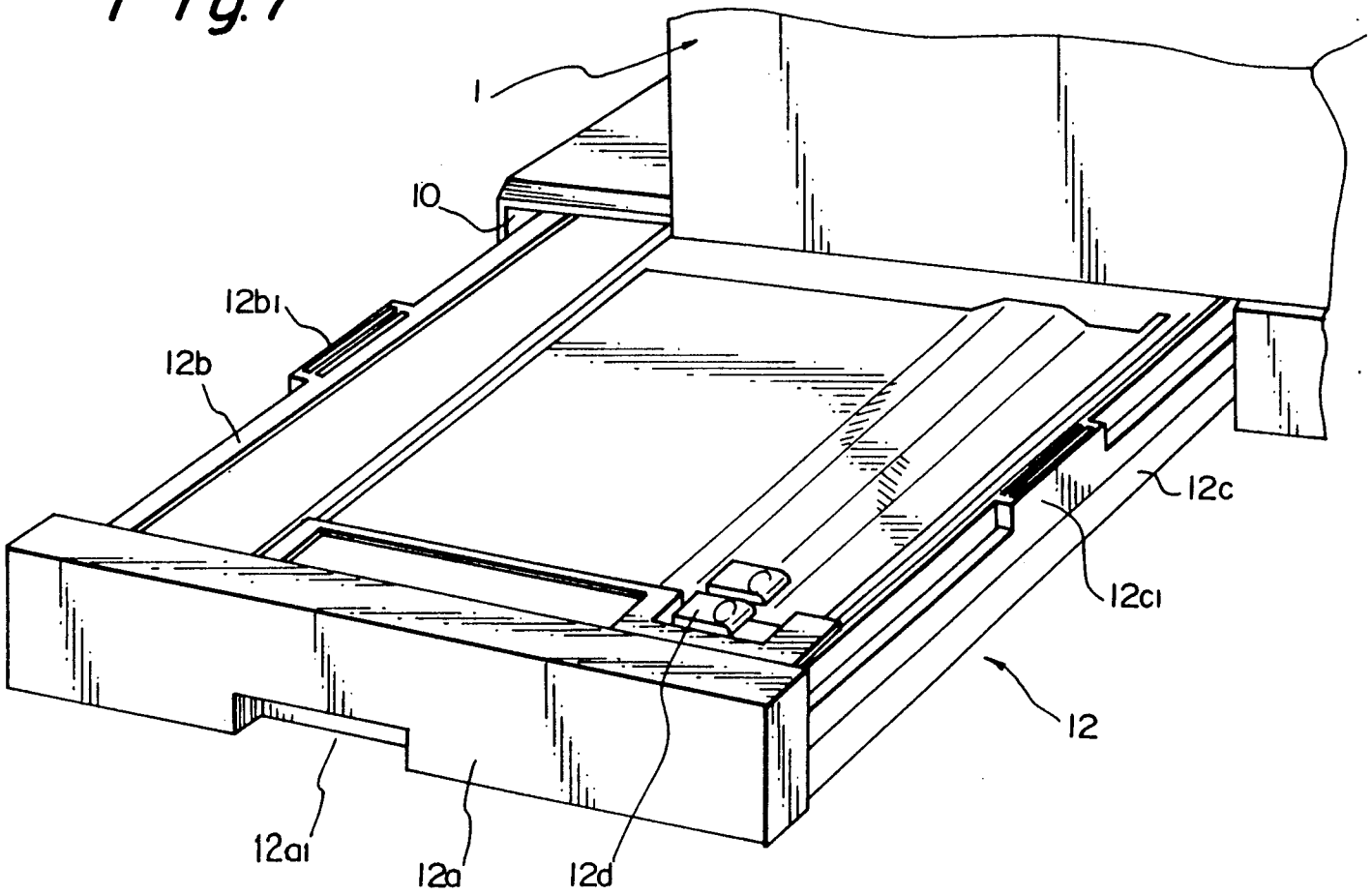
FIG. 7 is a fragmentary perspective view of the two-side unit of the illustrative embodiment.

Referring to FIG. 7, the two-side unit 12 is shown in a position where it has been pulled out halfway from the bore 10 of the copier body 1. As shown, the two-side unit 12 has a front cover 12*a* and side covers 12*b* and 12*c*. The front cover 12*a* is provided with a recess $12a_1$ at the lower intermediate portion thereof, while the side covers 12*b* and 12*c* are respectively provided with recesses $12b_1$ and $12c_1$ at their upper intermediate portions. The recesses $12a_1$, $12b_1$ and $12c_1$ each serves as a knob. The two-side unit 12 also has a knob 12*d* for opening and closing a guide plate adapted to remove a jamming paper sheet. As the operator pulls out the two-side unit 12 from the opening 10 of the copier body 1 by holding the knob $12a_1$, the two-side unit 12 is brought to a stop on abutment against a stop, not shown. Then, the operator may remove the two-side unit 12 from the copier body 1 by holding the knobs $12b_1$ and $12c_1$ of the side covers 12*b* and 12*c*.

Figure 8A:
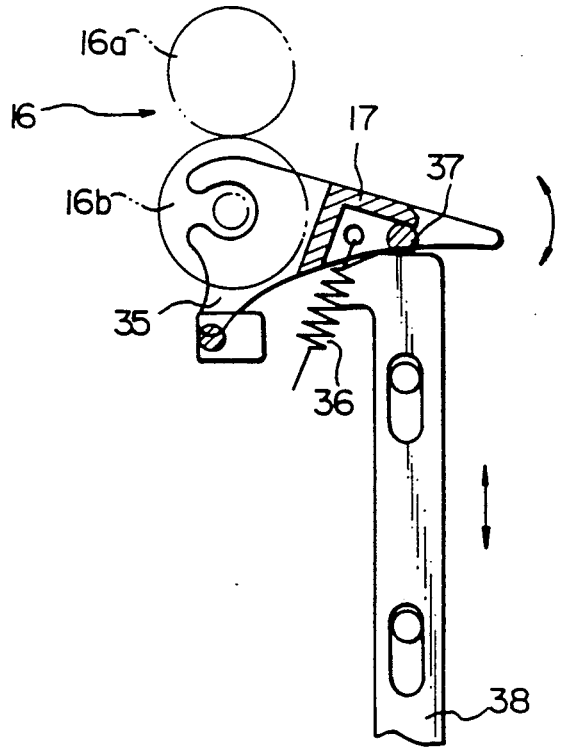
FIGS. 8A and 8B are sections showing a selector in the form of a pawl which is mounted on the apparatus body.
Figure 8B:
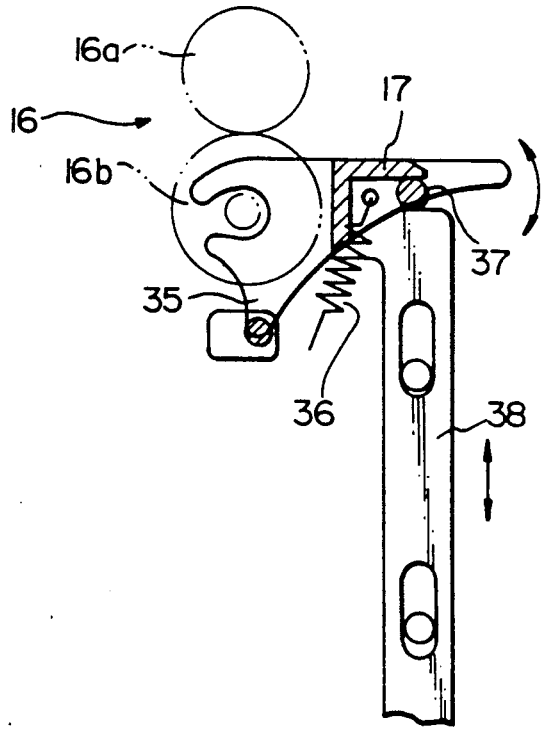
Figure 9A:
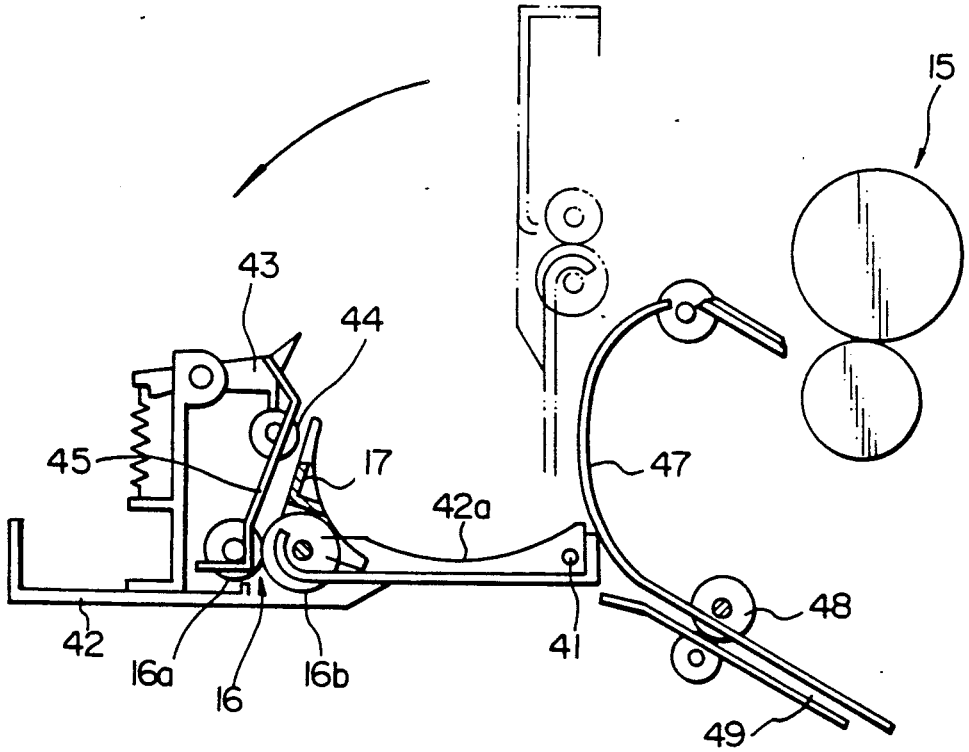
FIGS. 9A to 9E are sections each showing the selector and a curved guide section of the copier body in a particular operating condition.
Figure 9B:
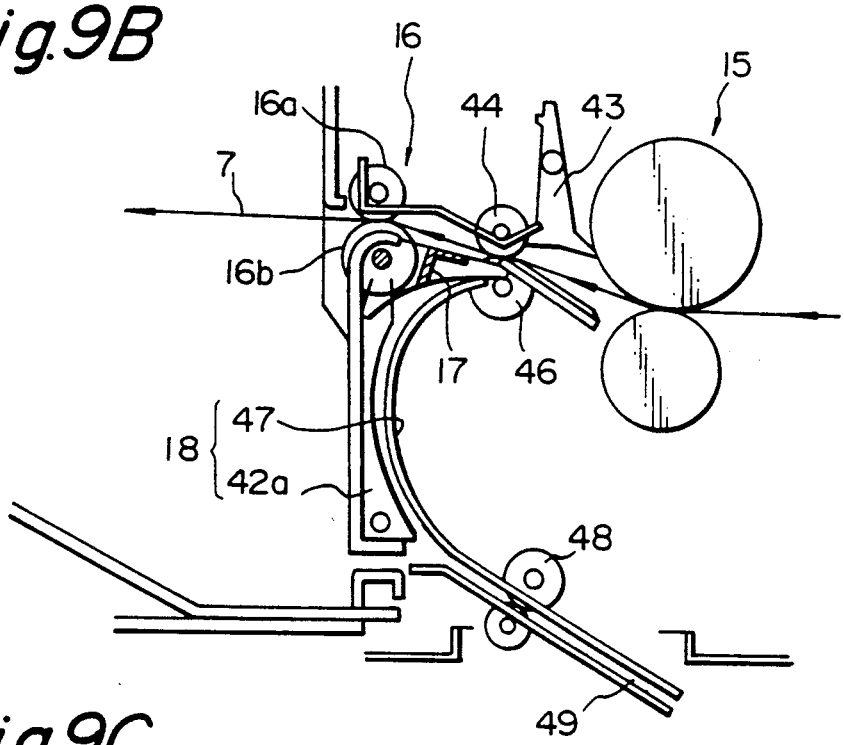

FIGS. 8A and 8B show a mechanism for actuating the selector 17, while FIGS. 9A and 9B indicate the relationship between the selector 17 and the curved guide section 18.

As shown in FIGS. 8A and 8B, the selector 17 is affixed to a support member 35. The support member 35 is constantly biased by a tension spring 36 clockwise about a shaft on which the lower roller 16*b* of the discharge roller pair 16 is mounted. A lug 37 extends out from the leading end of the support member 35 and is engaged with one end of an lever 38. As shown in FIG. 4, the other end of the actuating lever 38 is positioned in an upper portion of the two-side unit 12. When a solenoid 39 mounted on the two-side unit 12 is energized, it rotates an actuating piece 40 counterclockwise. Then, the actuating piece 40 urges the other end of the lever 38 upward against the action of the spring 36. As a result, the selector 17 is switched over from the position shown in FIG. 8A to the position shown in FIG. 8B. In this condition, the selector 17 allows the paper sheet 7 to advance toward the two-side unit 12 by way of the curved guide section 18. The paper cassette 6B is not provided with the lever 38 so that, when it is mounted on the copier body 1, the selector 17 remains in the position shown in FIG. 8A.

FIG. 9A shows means for removing the paper sheet 7 when the latter has jammed the transport path between the fixing unit 15 and the discharge roller pair 16. As shown, the discharge roller pair 16 carrying the selector 17 therewith is mounted on an outer cover 42 which is rotatable about a shaft 41 as indicated by an arrow in the figure. Specifically, when the outer cover 42 is rotated from a vertical position to a horizontal position, it uncovers the fixing unit 15 to facilitate the removal of the jamming sheet 7. The inner periphery of the outer cover 42 defines a part of the curved guide section 18. There are also shown in FIG. 9A a pawl 43 for preventing a paper sheet from wrapping round the fixing unit 15, an upper roller 44, and an upper guide 45 connecting the pawl 43 and upper discharge roller 16*a* to each other. The pawl 43, upper roller 44 and upper guide 45 are also mounted on the outer cover 42.

Figure 9C:
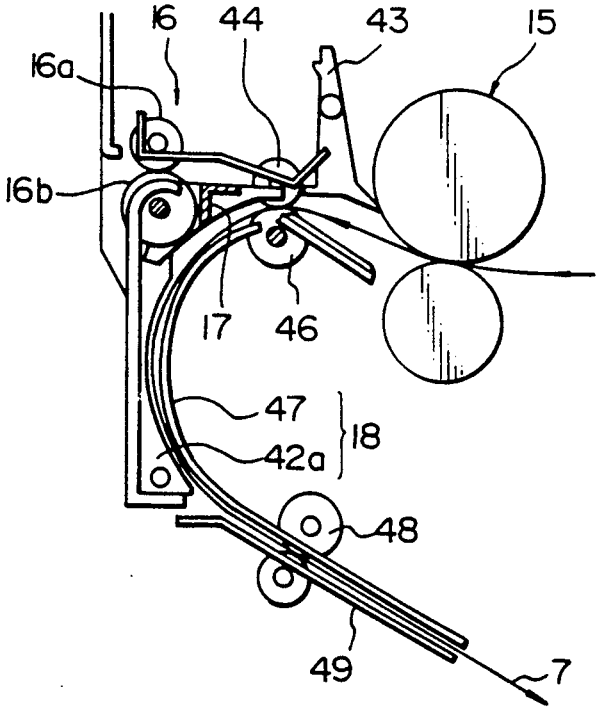

FIG. 9B shows a particular condition wherein a paper sheet is discharged during a usual copy mode operation or at the end of a combined copy mode or a two-sided copy mode operation. FIG. 9C shows another particular condition wherein a paper sheet carrying the first image on one side thereof is discharged during a combined copy mode or a two-sided copy mode operation. As shown in FIG. 9B, as the selector 17 intervening between the fixing unit 15 and the discharge roller pair 16 is rotated clockwise, a paper sheet is driven out of the copier body 1 by the discharge roller pair 16 by way of transport rollers 44 and 46 and the upper end of the selector 17. As shown in FIG. 9C, when the selector 17 is rotated counterclockwise, a paper sheet is routed through the transport rollers 44 and 46, the curved lower surface of the selector 17, and the curved guide section 18 to the two-side unit 12. The curved guide section 18 is made up of a path defined by the inner surface 42*a* of the outside cover 42 and a curved member 47, and a transport roller pair 48 and a guide member 49 which connect the above-mentioned path to the two-side unit 12.

Figure 9D:
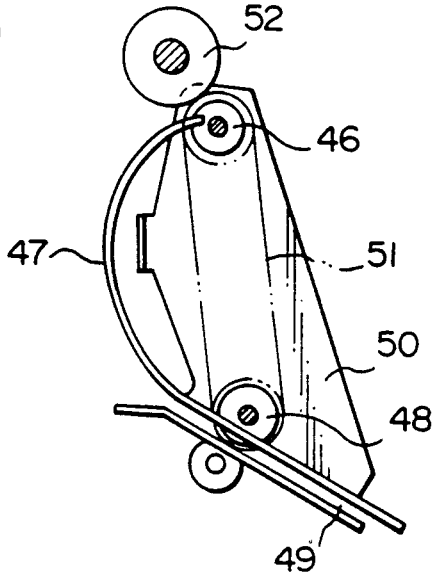

FIG. 9D shows a specific arrangement for allowing a predetermined part of the curved guide section 18 to be mounted and dismounted, as mentioned previously. Specifically, a support plate 50 carries therewith the lower transport roller 46 provided on the fixing unit 15, curved member 47, transport roller pair 48, and guide member 49. A drive belt 51 is passed over the lower transport roller 46 and the transport roller pair 48. The reference numeral 52 designates a drive gear mounted on the copier body 1. With this configuration, the support plate 50 can be attached to the copier body 1 by suitable positioning means such that a gear associated with the lower transport roller 46 meshes with the drive gear 52.

Figure 9E:
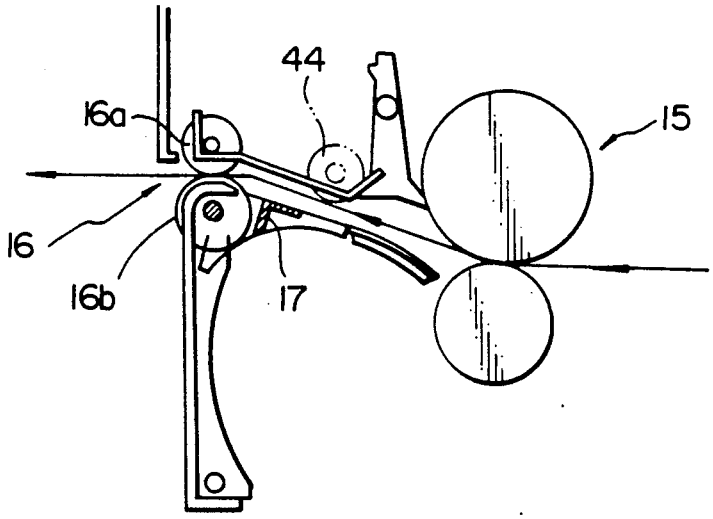

FIG. 9E shows how a paper sheet carrying an image on one side thereof as usual is transported when the predetermined part of the curved guide section 18 is removed from the copier body 1.

The illustrative embodiment displays a combined copy mode, a two-sided mode and an ordinary copy mode in distinction from each other, depending on which of the paper cassette 6B and two-side unit 12 is mounted on the copier body 1, and displays the paper size when the paper cassette 6B is mounted. Specifically, as shown in FIGS. 10A and 10B, four sensors or switches 53 are mounted side by side on the innermost wall 10*a* of the bore 10 of the copier body 1. On the other hand, the two-side unit 12 and paper cassette 6B each is provided with an actuator in the form of a contact member or members in positions corresponding to the sensors 53. Specifically, the two-side unit 12 has a contact member 54 so configured as to cover all of the four sensors 53, whereby a two-sided copy mode is displayed. The paper cassette 6B has contact members 55 which cover one to three of the sensors 53 depending on the size of paper sheets, whereby the size of paper sheets in use is displayed. Since such display is provided when the paper cassette 6B or the two-side unit 12 is accurately set in a predetermined position, the operator is allowed to see the loaded condition of thereof.

The illustrative embodiment also has means for positioning the cassette 6B or the two-side unit 12 in the bore 10 of the copier body 1. As shown in a section in FIG. 11A, the wall of the copier body 1 which forms the bottom of the bore 10 has locking lugs 56 and 57 adjacent to the innermost wall 10*a* and the inlet of the bore 10, respectively. The locking lug 57 is provided with an upward protuberance 57*a*. As shown in FIG.

11B, the paper cassette 6B has on its underside mating portions 58 and 59 adjacent to the innermost and outermost ends, respectively. The mating portion 59 is provided with a recess 59*a* which mates with the protuberance 57*a* of the lug 57. As shown in FIG. 11C, the two-side unit 12 is dimensioned slightly greater in height than the paper cassette 6B. Hence, the two-side unit 12 is provided on its underside with a mating portion 60 having a recess 60*a* which mates with the protuberance 57*a*, adjacent to the outermost end of the unit 12. Such a configuration allows the two-side unit 12 or the paper cassette 6B to be accurately positioned in the bore 10.

In summary, in accordance with the present invention, a paper cassette and a two-side unit have the same external configuration and are removably inserted one at a time into a bore of an apparatus body at a particular side where the apparatus is to be operated. This is successful in reducing the space to be assigned to the apparatus body and in allowing the two-side unit to be handled in the same manner as the paper cassette. Further, a paper sheet can be driven out of the apparatus body to a sorter which may be operatively connected to the rear end of the apparatus body.

Various modifications will become possible for those skilled in the art after receiving the teachings of the present disclosure without departing from the scope thereof.

What is claimed is:

1. an image forming apparatus comprising:

a two-side unit fittable into said image forming apparatus;

an apparatus body incorporating therein at least an image forming section, an image fixing section, a paper transporting section, and a paper discharging section;

an accommodating section provided in a predetermined portion of said apparatus body for selectively accommodating either one of said two-side unit and a paper cassette, said two-side unit including a guide path for guiding a paper sheet from the two-side unit directly to the image forming section, said two-side unit further including a temporary paper stacking space for sequentially stacking sheets to be later fed to said image forming section; and a path selecting section for selecting either one of a path for guiding a paper sheet coming out of said image fixing section to said paper discharging section, and a path for guiding said paper sheet to the two-side unit which is loaded in said accommodating section;

wherein said image forming apparatus is selectively operable in a two-sided copy mode and a combined copy mode when said two-side unit is loaded in said accommodating section;

wherein said predetermining portion of said apparatus body where said accommodating section is provided is located in a lower portion of said apparatus body;

wherein said accommodating section comprises a bore open at a side where said apparatus is the be operated, and a guide portion for guiding the two-side unit and the paper cassette;

wherein said accommodating section further comprises detecting means provided in said bore for detecting that one of the two-side unit and the paper cassette has been fully received in said accommodating section; and wherein the two-side unit and the paper cassette have the same external configuration.

2. An apparatus as coaimed in claim 1, wherein said detecting means comprises a plurality of switches disposed in said accommodating section, and actuators provided on the two-side unit and the paper cassette in positions corresponding to said switches each for actuating a predetermined number of said switches.

3. An apparatus as claimed in claim 2, wherein the number of said switches to be actuated by said actuator differs from the two-side unit to the paper cassette.

4. An image forming apparatus comprising:

a paper cassette storing stacked paper sheets;

a two-side unit having the same external configuration as said paper cassette;

an accommodating section provided in a predetermined portion of an apparatus body of said image forming apparatus for selectively accommodating either one of said two-side unit and said paper cassette; and guide means for guiding said paper sheet to the two-side unit which is loaded in said accommodating section in a two-sided copy mode;

said two-side unit including a temporary paper stacking space for sequentially stacking paper sheets to be later fed to an image forming section of the apparatus, jogger means for positioning the paper sheets stacked in said temporary paper stacking space, and transporting means for transporting said stacked paper sheets from said stacking space to said image forming section.

* * * * *